United States Patent [19]

Dupre

[11] Patent Number: 4,679,986

[45] Date of Patent: Jul. 14, 1987

[54] ENERGY CONSERVING REFRIGERATION APPARATUS AND METHOD

[76] Inventor: Milburn E. Dupre, 2105 Chapel Dr., Fairborn, Ohio 45324

[21] Appl. No.: 673,320

[22] Filed: Nov. 20, 1984

[51] Int. Cl.[4] ..... F04B 25/00; F04B 35/00

[52] U.S. Cl. ..... 417/53; 417/246; 417/248; 417/328; 417/392; 62/115

[58] Field of Search ..... 417/392, 328, 329, 246, 417/248, 244, 53; 251/79, 80; 62/115

[56] References Cited

U.S. PATENT DOCUMENTS

| | | | |
|---|---|---|---|
| 2,141,057 | 12/1938 | Whiles | 417/248 |
| 2,517,498 | 8/1950 | McGrath | 137/80 X |
| 2,828,694 | 4/1958 | Nallinger | 417/328 |
| 3,949,705 | 4/1976 | Portalis | 417/328 X |
| 4,120,172 | 10/1978 | Pierce | 62/115 |
| 4,211,093 | 7/1980 | Midolo | 62/505 |
| 4,369,633 | 1/1983 | Snyder | 62/117 |
| 4,449,363 | 5/1984 | Custer | 417/328 X |
| 4,449,899 | 5/1984 | Higa | 417/328 |

FOREIGN PATENT DOCUMENTS

| | | | |
|---|---|---|---|
| 381138 | 9/1923 | Fed. Rep. of Germany | 417/248 |

*Primary Examiner*—Carlton R. Croyle
*Assistant Examiner*—Ted Olds
*Attorney, Agent, or Firm*—Gerald B. Hollins; Donald J. Singer

[57] ABSTRACT

An energy-conserving refrigeration apparatus which employs a atmospheric pressure and vacuum-pressure actuated partial compressor for a refrigerant gas in combination with a conventional prime mover-driven compressor and also achieves lower compressor head pressure and increased condenser cooling of the refrigerant gas.

12 Claims, 8 Drawing Figures

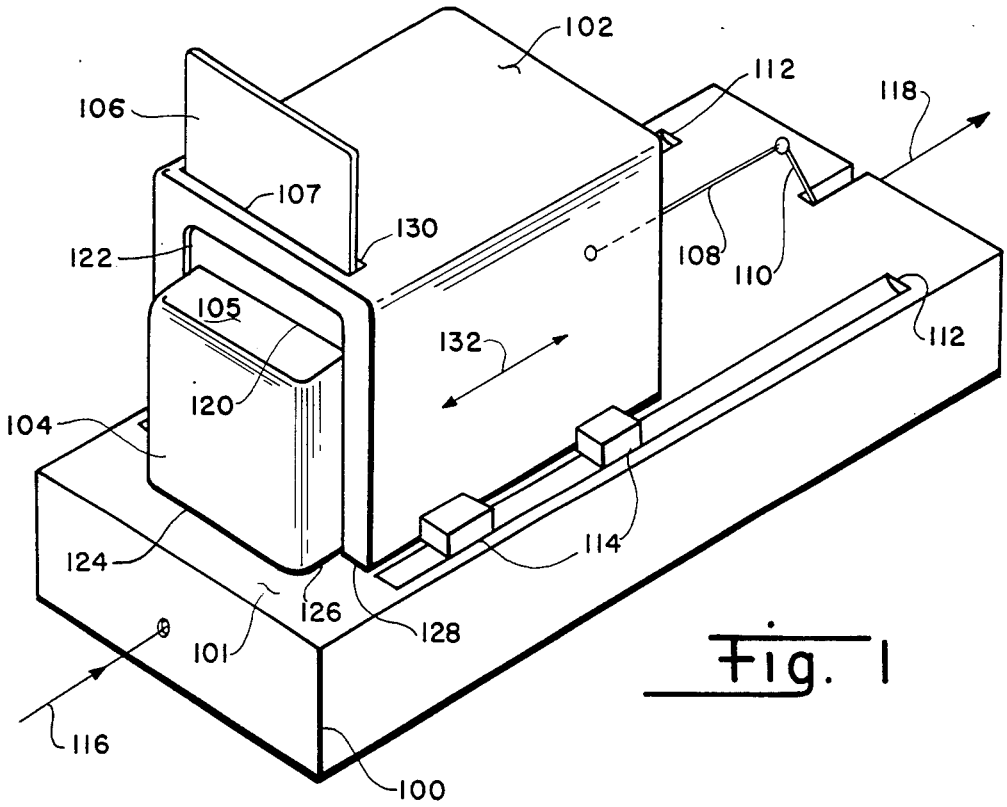
Fig. 1
Fig. 2
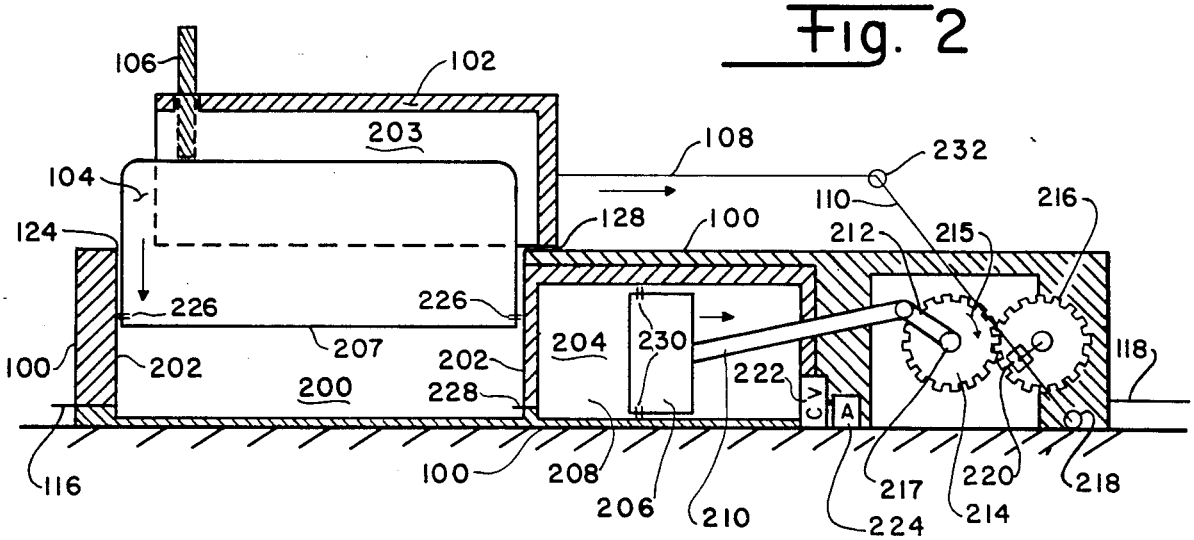

©1965, E. I. du Pont de Nemours & Company, Inc. (Used by permission.)

ENERGY CONSERVING REFRIGERATION APPARATUS AND METHOD

RIGHTS OF THE GOVERNMENT

The invention described herein may be manufactured and used by or for the Government of the United States for all governmental purposes without the payment of any royalty.

BACKGROUND OF THE INVENTION

This invention relates to the field of refrigeration apparatus incorporating energy-saving atmospheric pressure actuated compressor improvements.

Continuing increases in the cost of fossil fuel-derived energy, especially the higher rates of cost increase which commenced in the mid 1970's, has focused commercial attention on a variety of energy-conserving and energy-generating technologies which were previously difficult to justify economically. Included in such energy-conserving concepts is the addition of super-insulation to buildings and heat-operating appliances such as water heaters, cooking ranges and refrigerating equipment. Energy-capturing measures based on geothermal and solar heat wave also increased in commercial viability during this period. The now-popular practice of labelling an energy-consuming appliance in terms of its long-term energy consumption and an energy efficiency factor clearly reflects an increased concern for the cost of operting large energy consumption equipment such as the refrigeration machines for air conditioning and food storage.

Although improved insulation and improved electrical to mechanical transfer efficiency in refrigeration machines can significantly decrease the long term operating cost of such equipment, such improvements fall short of enhancing the underlying thermodynamic cycle of such equipment. Improvements which relate to this underlying thermodynamic cycle are nevertheless contemplated by the present invention. The present invention is moreover compatible in spirit with modern arrangements which employ solar energy or other naturally-occurring energy forms to supplement the energy derived from a fossil fuel source in a working apparatus. In the present invention the naturally-occurring energy is derived from atomospheric pressure.

The patent art includes several examples of thermodynamic cycle apparatus employing unusual compression arrangements. Included in this art is the U.S. Patent of Bill L. Pierce, U.S. Pat. No. 4,120,172, which concerns a heat transport system principally intended for use in a small, high-reliability apparatus such as a nuclear-powered artificial heart. In the Pierce apparatus a pressurizer vessel serves as a pneumatic spring between vaporizer and condenser elements of a heat transport system. The pressure vessel's compressor action contemplates the use of a diaphragm located between a pressure chamber and the vaporizer-condenser communicated compression chamber. In one arrangment of the Pierce apparatus, the pressurizer volume is increased to infinity by opening the pressure chamber to the atmosphere and employing a vertical stem pipe and atmospheric pressure as a portion of the pressurizer apparatus. The Pierce apparatus contemplates the use of methanol or acetone as the working fluid and achieves heat transfer between a heat source operating at 150° F. and a heat sink operating at 140° F. or alternately, a source operating at 120° and a sink at 105° F.; these heat transfers are achieved in the nucleate boiling mode of operation.

The patent of Lawrence L. Midolo, U.S. Pat. No. 4,211,093, is also included in the refrigeration art. The Midolo patent concerns a vapor cycle cooling system which employs a rotary vane compressor having two stages and two levels of working fluid compression and arranged such that the output of the lower pressure compressor stage is received into the input of the higher pressure state. The Midolo apparatus also contemplates the use of an output flow from one expansion valve to cool the input flow of a second expansion valve.

The patent of David A. Snyder, U.S. Pat. No. 4,369,633, is concerned with a multiple-stage compressor having a flash gas injection arrangement wherein gases of two different pressures can be compressed simultaneously. The Snyder invention uses two separate compression chambers in order to utilize a vapor fraction of partially-expanded refrigeration fluid to add the high-pressure gas in the system condenser coil. The Snyder patent also identifies several previous patents concerned with refrigerant compressors having multiple compression chambers.

SUMMARY OF THE INVENTION

An object of the present invention is to provide an energy-conserving refrigeration compressor.

Another object of the invention is to provide a refrigeration compressor wherein a portion of the work performed on the refrigerant medium is derived from atmospheric pressure.

Another object of the invention is to provide a vacuum conserving arrangement for the vacuum or low pressure used in achieving part of the refrigeration operating cycle.

Another object of the invention is to provide a refrigeration apparatus capable of maintaining a fixed temperature difference between the condensing coil and the surrounding atmospheric temperature.

Another object of the invention is to provide a two-stage refrigeration compressor capable of employing two different types of energy input.

Another object of the invention is to provide a refrigeration compressor apparatus having a free, or slighly limited, piston compression cycle which operates over differing time periods in the compression and return stroke movements.

Another object of the invention is to provide a refrigeration compressor valve capable of responding to external conditions with changes in operating characteristics.

These and other objects of the invention are achieved by providing a low-pressure to intermediate-pressure compressing apparatus that includes a movable free piston member fitted for reciprocal motion in a compressing cylinder so that a working side is exposed to a vaporizable liquid refrigerant medium and a worked-upon side is exposed alternately to atmospheric pressure and a pressure lower than atmospheric pressure, together with means for compressing the refrigerant medium from the intermediate pressure to a higher pressure, the higher pressure including refrigerant temperatures above ambient temperature. Also provided is condensing heat exchanger means for lowering the temperature of the higher-pressure refrigerant to near the ambient temperature and condensing the refrigerant thereby to the liquid state and evaporating means located in communication with a heat-supplying closed atmosphere for converting the refrigerant medium from the liquid state to a gaseous state thereby cooling the closed atmosphere.

BRIEF DESCRIPTION OF THE DRAWINGS

FIG. 1 is a perspective schematic overall view of a refrigeration compressor according to the invention.

FIG. 2 is a cutaway side view of the FIG. 1 compressor.

DETAILED DESCRIPTION

Figure 4:
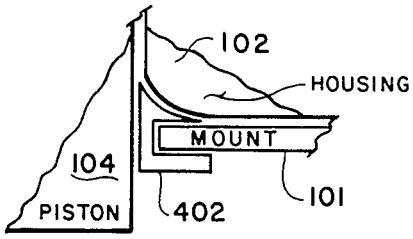
FIG. 4 shows a possible arrangement for some of the moving member gas seals in the FIGS. 1–3 apparatus.
Figure 6:
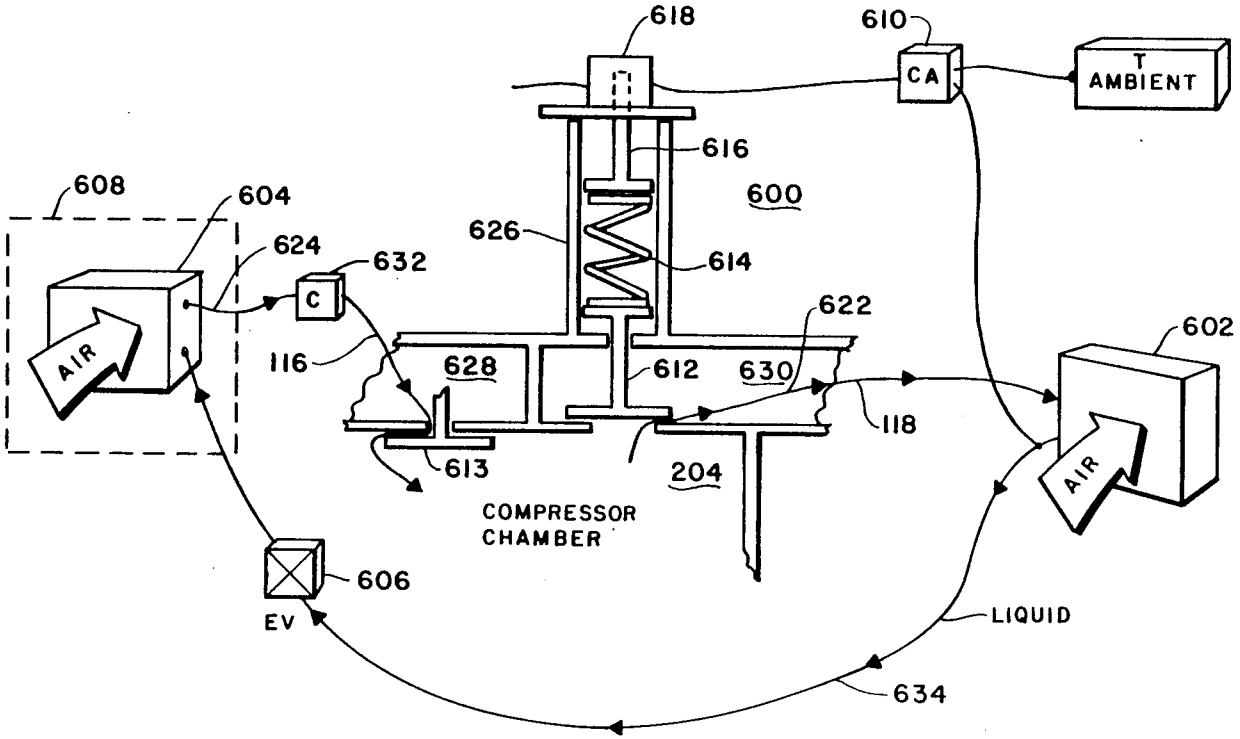
FIG. 6 is a schematic diagram of a valve arrangement usable with the refrigeration apparatus, together with related components of an incorporating refrigeration system.

A perspective schematic view of a refrigeration compressor apparatus made in accordance with the present invention is shown in FIG. 1 of the drawings. The FIG. 1 schematic includes a compressor mounting base enclosure 100, a reciprocally-movable vacuum housing 102, a free piston member 104, a seal plate 106, and a drive arrangement which includes connecting links 108 and 110. The FIG. 1 schematic also shows a pair of ball bearing skids 114 which are arranged to move reciprocally in a pair of troughs 112 located in the top surface 101 of the mounting base enclosure 100; a similar pair of ball bearing skids are located on the rear side of the vacuum housing 102 in a position not shown in FIG. 1. The FIG. 1 apparatus also includes a compressor input port 116 and an outlet path 118 that can be connected as shown in FIG. 6 of the drawings in a refrigeration system. Additional details of the compressor schematic shown in FIG. 1 include the edges 124 and 126 of a well or cylinder in the mounting base enclosure 100. The well or cylinder also forms the compression chamber 200 in FIG. 2 and receives the piston 104. The double-ended arrow 132 in FIG. 1 indicates the movement of the vacuum housing 102 along the troughs 112 to cover and uncover the piston 104. Flexible vacuum seal members, which are not shown, are located between the respective moving parts in FIG. 1; these seals are located at the mating surfaces 120 and 122 between the piston 104 and the seal plate 106 and also at the mating surfaces 128 and 130 between the vacuum housing 102 and the mounting base enclosure top surface 101, and also at 130 in the seal plate aperture 107 of the vacuum housing 102. A possible configuration for the seal at the mating surface 128 is shwon in FIG. 4 of the drawings.

Figure 3:
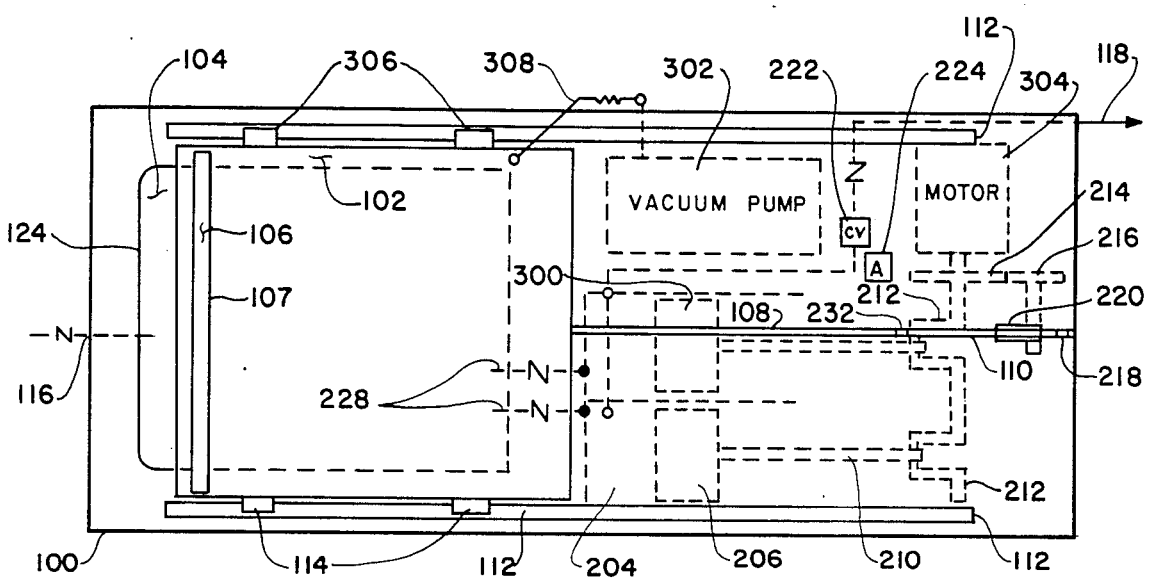
FIG. 3 is a cutaway top view of the FIG. 1 compressor.

Additional details of the FIG. 1 compressor apparatus are shown in the FIG. 2 cross-sectional view drawings and the FIG. 3 top view. The FIG. 1 elements which repeat in FIG. 2 and FIG. 3 are identified with the same number as used in FIG. 1. Other details of the compressor apparatus shown in FIG. 2 include a side view of the compression chamber 200 which includes the well or cylinder walls 202, and a secondary higher-pressure compressor 204 of the motor-driven positive displacement type. The compressor 204 includes a compression chamber 208, a piston 206, a connecting rod 210 and a motor-driven crank arm 212. The crank arm 212 is connected to a gear 214 that is mounted on the shaft 217 of a motor 304 as shown in FIG. 3. The gear 214 and a mating gear 216 are engaged at their common interface to transmit motive power between the motor and connecting link 212. A second piston 300 which is shown synchronized with the piston 206, but which may be located in 180° phase displacement with respect to the piston 206, is shown in FIG. 3 of the drawings.

Additional details of the compressor apparatus visible in the FIG. 2 drawing include the quick return coupling 220 which is used to drive the connecting link 110 in cooperation with a pivot point 218; a controlled condenser check valve 22 and a check valve actuator 224 are also shown in FIG. 2 and in FIG. 3 of the drawings. Further details of the FIG. 1 compressor shown in FIG. 2 include the sealing rings 226 and 230 for the pistons 104 and 206 and a connecting path 228 between the compression chamber 200 and the compression chamber 204 and the pivoted connection 232 between the connecting links 108 and 110.

Details of the FIG. 1 compressor which appear for the first time in FIG. 3 include the second piston member 300, a vacuum pump 302, the driving motor 304, a second pair of ball bearing skids 306, and a connection path 308 between the vacuum pump 302 and the vacuum housing 102.

As explained below in connection with the FIG. 5 enthalpy diagram drawing, the underlying concept for operation of the FIG. 1 compressor involves saving energy through the use of atmospheric pressure to achieve part of the refrigerant gas compression needed in an air conditioning or refrigeration compressor application. With respect to FIG. 1, the atmospheric compression is achieved by the action of atmospheric pressure on the top or worked-upon surface 105 of the piston 104, this action causing the working surface 207 to partially compress the refrigerant gas in the chamber 200. Return of the piston 104 from a compression stroke is achieved in the FIG. 1 apparatus by exposing the worked-upon surface 105 to a low pressure or vacuum atmosphere which is maintained in the low pressure-vacuum chamber 203 of the housing 102. Following the compression of the refrigerant occurring in the chamber 200, elevation of the pressure to the levels desired for refrigeration use is achieved in the motor-driven compressor secondary stage by the pistons 206 and 300 shown in FIGS. 2 and 3 of the drawings.

A refrigerant gas having a high specific volume and moderate pressure requirements is preferable for use in the FIGS. 1–3 compressor apparatus. The refrigerant gases R-113 and R-11 comprise the principal family suitable for this use; the gas R-11 being preferable, as is described below. The R-11 and R-113 refrigerant gases are two gases from a large family of such gases that are known in the refrigeration and heating arts. These gases are generically called Freon ® gases and are manufactured by EI duPont de nemours Inc. of Wilmington, Del. and by other manufacturers. The name Freon ® is a duPont trademark. Other refrigerant gases such as ammonia, sulfur dioxide or other gases could of course be used with the invention with less desirable results.

According to one aspect of the FIG. 1 apparatus, the vacuum or low-pressure in the chamber 203 is accorded a maximum interval of time in which to raise the piston 104 from the compression chamber 200 by the quick return nature of the coupling 220, that is, by according the link 110 the geater proportion of a revolution time of the shaft 217 in locating the housing 102 over the piston 104.

As indicated previously, gas-tight seals are required at the mating surfaces 120, 122, 128 and 130 in FIG. 1 and such seals allow the vacuum or low-pressure condition established in the chamber 203 to be preserved for repeated use in allowing the piston 104 to rise in the compression chamber 200. It is, of course, desirable for this maintenance to occur with minimal energy consuming operation of the vacuum pump 302. The achieving of perfect vacuum-tight seals at these locations, especially in the presence of relative motion betewen thé sealed parts is, of course, a practical impossibility and will therefore require at least periodic operation of the vacuum pump 302. The achievement of seals capable of requiring vacuum pump operation only periodically during operation of the FIG. 1 compressor is believed within the state of the art and known to persons skilled in the seal art. A possible configuration for the seal between the piston 104, the mounting surface 101 of the mounting enclosure 100, and the vacuum housing 102 is shown at 402 in FIG. 4 of the drawings. Other and better arrangements for the seal 402 are, of course, possible. It must also be recognized that the shape of the atmospheric piston and vacuum housing can be altered to achieve better, tighter, and more effective seals.

Figure 5:
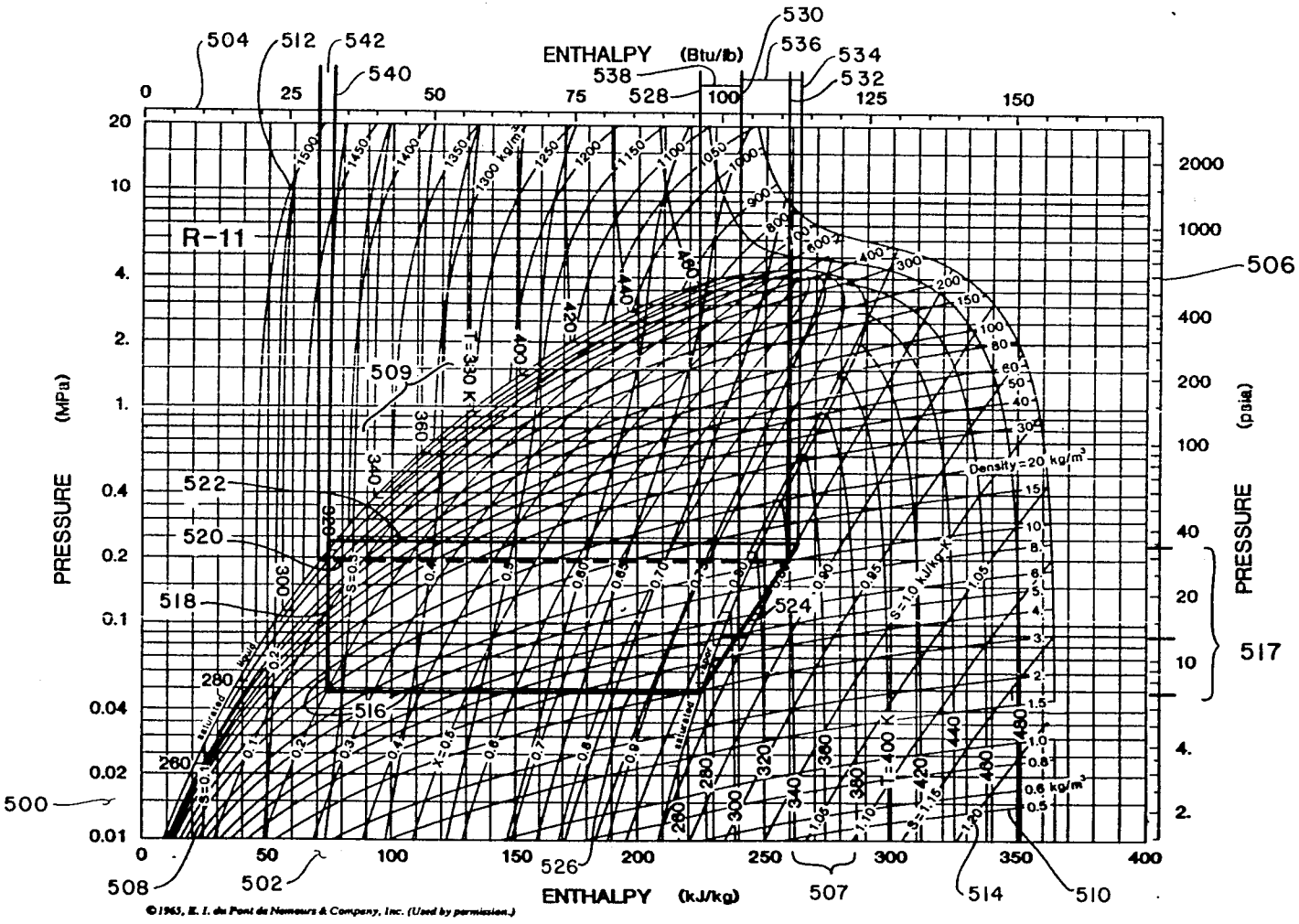
FIG. 5 is a pressure versus enthalpy diagram for one refrigerant gas employable in the FIG. 13 apparatus.

The theoretical basis for employing partial atmospheric compression of the refrigerant gas in the FIG. 1 apparatus may be appreciated from the pressure versus enthalpy characteristic diagram for the refrigerant gas R-11 which is shown in FIG. 5 of the drawings and additionally from the simplified representation of the diagram shown in FIG. 8 of the drawing and described below. The R-11 diagram portion of the FIG. 5 drawing is used herein by courtesy of E. I. duPont deNemours and Company, Inc. and is copyright protected by duPont. FIG. 5 shows a refrigeration cycle 516 overlaying this standard R-11 pressure versus enthalpy family of curves. As is known by persons skilled in the refrigeration art, scales 500 and 502 in FIG. 5 indicated quantitative measurements of pressure and enthalpy and correspond to a second pair of scales 504 and 506 which are graduated in conventional units of btu per pound and pounds per square inch absolute. Also shown in FIG. 5 is a range of temperatures 507 and 509, a scale of refrigerant densities ranging between 0.5 kilograms per cubic meter at 510 and 1500 kilograms per cubic meter at 512, a range of enthalpy values between 1.20 kilojoules per kilogram at 514 and 0.1 kilojoules per kilogram at 508. The FIG. 5 diagram also includes values of X where X is a variable representing quality; the ratio of gas mass to liquid mass in the two-phase saturated mixture region; "X" is of no particular importance in the present description, however. The variable S in FIG. 5 represents entrophy; constant S lines in the diagram represent lines of reversible work. If a compressor could compress the refrigerant gas without loss, the resulting compression would follow a constant "S" line.

The refrigeration cycle events of compression, cooling, expansion, and heating, are incorporated in the cycle 516 which overlays the FIG. 5 enthalpy chart. In cycle 516, the line 524 represents the action of the compressor on the refrigerant gas, while the lines 520 or 522 represent cooling of the gas in a condenser coil and the vertical line 518 represents the throttling event or decreasing of pressure on the gas in an expansion valve or capillary tube, for example, The horizontal line 526 represents heating and expansion of the gase as a result of cooling the refrigerated atmosphere, and is therefore the measure of the refrigeration effect achieved by the cycle 516.

The sloping line 524 portion of the refrigeration cycle 516 is of interest with respect to the FIG. 1 compressor apparatus, since the change incurred by the refrigerant gas along this line is achieved with the input of externally-supplied work or energy. As shown by the tick marks 517 in FIG. 5, the refrigerant gas undergoes a pressure change from 7 pounds per square inch absolute to about 33 pounds per square inch absolute with a temperature change from approximately 280° K to 340° K (7° F. to 67° F.). An enthalpy change from 97 btu per pound to 113 btu per pound and a density change from 3 kilogrms per cubic meter to approximately 12 kilograms per cubic meter accompanies this pressure change. The enthalpy values of 97 and 113 btu per pound at the start and completion of the compression line 524 are indicated at 528 and 534 in FIG. 5, and represent the energy of 16 btu per pound which must be supplied by the compressor to maintain operation of the refrigeration cycle 516. Additional description of a refrigeration cycle and significance of the cycle with respect to charts of enthalpy and entropy is located in the article "Refrigeration" appearing at page 459 of Volume 11 in the McGraw-Hill Encyclopedia of Science and Technology, copyright 1982 by McGraw-Hill Inc. The refrigeration article is hereby incorporated by reference herein.

According to the present invention, a significant part of the compressor supplied 16 btu per pound or actually the 6 btu per pound energy difference between the lines 528 and 530 in FIG. 5 is supplied by atmospheric compression and the action of the piston 104 in FIG. 1. The remainder of the enthalpy increase, from 103 to 113 btu per pound, as indicated by the distance 536 between the lines 530 and 534, is supplied by the compressor motor 304 in accordance with a conventional refrigerant gas compression arrangement. Use of the atmospheric compressor and the piston 104 therefore provides an energy saving of 6 btu per pound or about 37.5% of the total energy to be supplied by the motor 304 in the FIG. 5 refrigeration cycle arrangement. In heat pump operation, because of lower evaporator temperature, even greater energy savings can be achieved, with savings in the range of 60% being feasible. A portion of this saved energy, of course must be devoted to operation of the vacuum pump 302 in order to maintain a desirable low pressure in the chamber 203; vacuum pump operation is, however, desirably of an intermittent and small energy consumption nature—through the use of efficient seals at the moving mating surfaces of the FIG. 1 compressor apparatus.

The compressor operated by the motor 304 is shown to be a two-cylinder type employing synchronous displacement of the pistons in the cylinders in FIG. 3 of the drawings. Other compressor arrangements including 180 degree piston separations on the shaft 217 or single- or additional-piston positive displacement compressors or a centrifugal or screw thread compressor could, of course, be employed. In a similar manner, the refrigeration cycle 516 in FIG. 5 is but one of many such cycles which could be employed in embodying the invention.

Alternate refrigeration fluids may also be employed in embodying the invention, the illustrated R-11 refrigerant is, however, found to have desirable low-pressure and low temperature properties. The R-11 refrigerant, for example has the desirable characteristic of achieving the 35° F. temperature needed in the coils of an air conditioning unit with modest levels of absolute pressure, that is, without the attainment of high vacuum conditions which would increase the performance required of the moving seals between members of the FIG. 1 compressor apparatus. The R-11 refrigerant, for example, requires about 5 PSIA to achieve the desired 35° F. temperature in comparison with the closest alternate refrigerant, R-113, which would require pressures in the range of ½ to 1.0 PSIA.

A tradeoff between seal capability and thermodynamic efficiency is therefore applicable in the FIG. 1 apparatus—the R-113 refrigerant will provide higher thermodynamic efficiency if suitable seals to support operation at low absolute pressures are available and if the expense of greater vacuum pump energy requirements is acceptable. Full-time operation of the vacuum pump 302 would, of course, be undesirable and would cause possibly the FIG. 1 compressor to operate at thermodynamic efficiency below that of a conventional motor-driven compressor, since losses in the vacuum pump would be added to losses in the compressor.

With respect to total cycle energy requirements of the FIG. 1 apparatus, it should be realized that movement of the vacuum housing 102 between its end positions covering and substantially uncovering the piston 104 bears similarity to the stretching and relaxing of a spring in that energy is required to remove the housing from a position covering the piston 104, however, much of this energy is returned during return of the housing 102 to the position covering the piston. The net energy used in housing movement is therefore primarily attributed to losses in the mating surface sealing members 120, 122, 128 and 130.

The force acting on the seals at the mating surfaces 128 and 130 are largely determined by the pressure times area relationship for the associated surface with atmospheric pressure acting on one side and vacuum or low pressure on the opposite side. The force at the mating surface 120, however, is preferably maintained through the use of a spring or other resilient means which is not shown, since atmospheric pressure is less effective in maintaining the desired engagement at this surface during lateral movement of the housing 102.

Many alternate arrangements of the thus-far described energy conserving refrigeration apparatus can, of course, be envisioned. These alternate arrangements include, for example, use of some other shape or other cooperation of elements to retain a vacuum space while providing for the communication of this vacuum over the acted-upon surface of a compressing member such as a piston; communication arrangements such as are achieved in the FIG. 1 apparatus are, of course, desirable for this vacuum transfer, in preference to valving arrangements, since valving and the displacement of air would require replenishment of the vacuum and consequent energy losses. These alternate arrangements can also include a physical configuration wherein the acted-upon and active surfaces 105 and 207 have different physical sizes and different surface areas. Yet another alternate arrangement of the FIG. 1–3 compressor apparatus would invovle the use of close-fitting piston and cylinder wall elements in order that the moving seals at 226 and 230 be eliminated and reliance upon lubrication and small physical separation be feasible.

It may also be found desirable as an alternate to the FIG. 1–FIG. 3 arrangement to synchronize the motion of the vacuum housing 102 and the pistons 206 and 300 in a different relationship than is shown in FIGS. 2 and 3 of the drawings. The syncrhonization achieved is preferably arranged such that downward motion of the piston 104 at the time of leftward motion of the piston 206 is avoided since transfer of the gas compressed in the chamber 200 to the chamber 204 by way of the connecting path 228 is desired. Parallel operation of the pistons 206 and 300 as shown in FIGS. 2 and 3 may therefore be preferble to the 180° piston phase displacement suggested above.

The line 532 in FIG. 5 of the drawings, intermediate the distance and work between the lines 530 and 534, illustrates an energy-conserving arrangement which may be attained in the exhaust valving of the motor-driven compressor 204. This energy saving may be comprehended by realizing that conventional practice in the design of air conditioning apparatus calls for the condensing heat exchanger to be designed for a worst case operating condition such as a 100° F. ambient temperature and for achieving operating pressures sufficient to give a 20 degree F., for example, gas temperature above this highest ambient temperature. Cooling of the compressed gas over this 20 degree range, from a temperature of 120° F. to 100° F. would, of course, occur in the condensing heat exchanger such as the heat exchanger 602 in FIG. 6. In the event of the ambient temperature reaching 120°, cooling and condensing would largely terminate. In further accord with such conventional practice, on a cooler ambient temperature day such as an 85° F. day, the refrigerant pressure-temperature in the compressor 204 and entering the condensing heat exchanger 602 tends to continue the 120° level, a level which is not required on the cooler day and which therefore represents unneeded energy expenditure by the compressor.

In FIG. 6 there is shown a valve arrangement which is capable of modifying the pressure attained in the compression chamber 204 and the condensing heat exchanger 602 on cooler than maximum design days. The FIG. 6 valve is a compressor exhaust valve and is shown re-oriented from its FIG. 2 horizontally disposed, but not shown position in FIG. 6 of the drawings.

The FIG. 6 apparatus includes a cutaway portion of a compressor cylinder and head 600; this apparatus is comprised of an exhuast valve 612, an intake valve 613, together with intake and exhaust manifolds 628 and 630 which communicate respectively with refreigerant received from an evaporator 604 and the condensing heat exchanger 602. Refrigerant from the evaporator 604 is communicated along the path 624 to an optional atmospheric compressor which is shown in block form at 632 and thence along the path 116 to the intake valve 613 and the compression chamber 204. In similar fashion, compressed refrigerant fluid from the compression chamber 204 travels along the path 622 in the exhasut manifold 630 and thence along the path 118 which is shown in both FIG. 6 and FIG. 1 to the condensing coil 602. The refrigerant circuit in the FIG. 6 drawing is completed by the path 634 to an expansion or throttling valve 606 and the evaporator heat exchanger 604. Airflow over the heat exchangers 602 and 604 is presumed as indicated. The air flow over the evaporator coil 604 is presumed to be from a closed and refrigerated atmosphere which is indicated at 608.

The FIG. 6 apparatus further includes an exhaust valve tension spring 614 and a valve spring biasing member 616 which is positioned by an actuator apparatus 618 of the electrical or pneumatic or other known types. The actuator 618 in FIG. 6 is energized by a control apparatus 610 which monitors the temperature at the output of the condensing heat exchanger 602 in relationship to the ambient temperature.

The intent of the FIG. 6 arrangement is to maintain a constant difference temperature between the temperature of the condensing coil output along the path 634 and the ambient temperature. This constant temperature difference is achieved by decreasing the tension on the exhaust valve spring 614 when temperature differences greater than the predetermined difference temperature such as the above-recited 20 degrees, for example, are encountered between the ambient and condensing coil fluid output temperatures. By maintaining this constant difference temperature between the ambient and the condensing heat exchanger output, operation of the FIGS. 1–3 apparatus can be relieved of attaining some portion of the pressure normally encountered in the condensing heat exchanger 602. The relieved pressure is indicated by the distance and the work represented between the line 532 and 534 in FIG. 5 of the drawings. Operation up to the value of enthalpy indicated by the line 532 in FIG. 5 allows the FIG. 6 pressures in the condensing heat exchanger 602 to be as indicated by the line 520 rather than the line 522 in FIG. 5. These lower pressure values, of course, result in decreased energy expenditure by the motor 304. Although not shown in FIG. 5, the lower of the condensing line from 522 to 520 in FIG. 5 also actually displaces the heat absorbing or refrigeration expansion line 526 in FIG. 5, causing the system to have a slightly greater refrigerating capacity. This increased capacity results from the exhaust valve providing the lowest possible condenser pressure and temperature.

Figure 7:
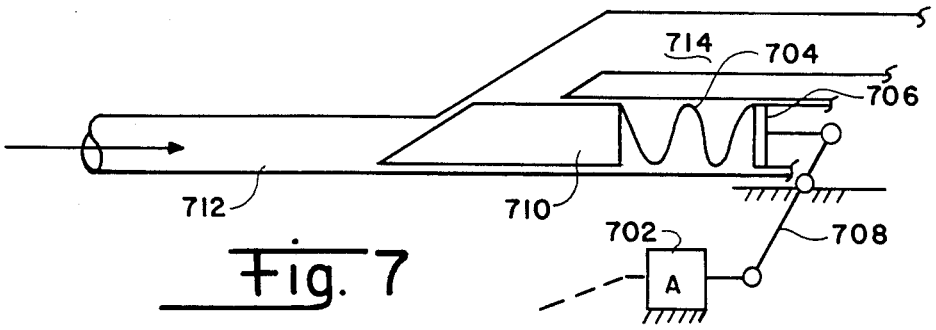
FIG. 7 is an alternate symbolic arrangement for the FIG. 6 valve.

A schematic arrangement of the pressure regulating exaust valve is shown in FIG. 7 of the drawings. In the FIG. 7 valve refrigerant gas entering an inlet port 712 is communicated to an outlet port 714 by way of a valving member 710 which is urged into the closed position by tension spring 704; the spring 704 is in turn biased by an actuator 702 operating through a linkage 708 on a biasing member 706. The actuator 702 in FIG. 7 corresponds to the combination of the elements 610 and 618 in FIG. 6.

Figure 8:
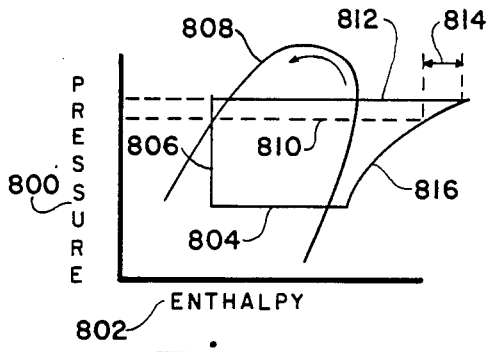
FIG. 8 is a pressure enthalpy diagram of smaller size showing additional details of the compressor and valve arrangement.

The enthalpy chart relationships described above in connection with FIG. 5 are shown in simplified and clarified form in FIG. 8 of the drawings. In FIG. 8 the action of the compressor on the refrigerant fluid occurs along the line 816, the condensing coil acts along the lines 810 or 812 and throttling or expansion occurs along the line 806, while heat absorption or refrigeration occurs along the line 804. In FIG. 8 relieving of the compressor pressure by the FIG. 6 and FIG. 7 valve arrangements is indicated at 814 and the pressure difference resulting from such a FIG. 6 and FIG. 7 valve arrangement indicated by the space between lines 810 and 812. The pressure and enthalpy scales are indicated at 800 and 802 in FIG. 8.

Another energy conserving arrangement applicable to the FIGS. 1–3 compressor apparatus is represented by the lines 540 and 542 in FIG. 5. The distance between these lines indicating the gain of enthalpy resulting from cooling a liquid refrigerant below the temperature of condensation to a temperature approaching the atmospheric temperature, the distance separating the lines 540 and 542 is also added to the length of the line 526 which represents the refrigerating capability of the cycle 516.

While the apparatus and method herein described constitute a preferred embodiment of the invention, it is to be understood that the invention is not limited to this precise form of apparatus or method, and that changes may be made therein without departing from the scope of the invention, which is defined in the appended claims.

I claim:

1. Multiple-stage compressor apparatus comprising:

a rotationally drivable intermediate pressure to high-pressure compression stage having a first compression chamber which includes inlet and outlet portions capable of respectively receiving intermediate pressure working fluid and delivering higher pressure working fluid;

a low pressure stage having a second compression chamber located within a housing member and including inlet and outlet port portions capable of respectively receiving low-pressure working fluid and delivering intermediate-pressure working fluid to said intermediate- to high-pressure compression stage inlet port;

said low pressure stage further including a movable piston member located in said second compression chamber and exposed on a first face thereof to said working fluid at said low-to-intermediate working fluid pressures; and means exposing a second face of said movable piston member alternately to atmospheric pressure and to pressure less than atmospheric pressure for moving said piston into and out of said low-pressure stage second compression chamber and for thereby compressing said working fluid from said low pressure to said intermediate pressure.

2. Multiple stage compressor apparatus comprising:

a rotationally drivable intermediate pressure to high-pressure compression stage having a first compression chamber which includes inlet and outlet portions capable of respectively receiving intermediate pressure working fluid and delivering higher pressure working fluid;

a low pressure stage having a second compression chamber located within a housing member and including inlet and outlet port portions of respectively receiving low-pressure working fluid and delivering intermediate-pressure working fluid to said intermediate to high-pressure compression stage inlet port;

said low pressure stage further including a movable piston member located in said second compression chamber and exposed on a first face thereof to said working fluid at said low-to-intermediate working fluid pressures; and means exposing a second face of said movable piston member alternately to atmospheric pressure and to pressure less than atmospheric pressure for moving said piston into and out of said low-pressure stage second compression chamber and for thereby compressing said working fluid from said low pressure to said intermediate pressure;

said means exposing said piston face to atmospheric pressure and to pressure less than atmospheric pressure including a movable member locatable in a first position substantially covering said piston second face side and in a second position substantially disengaged from said piston and exposing said piston to atmospheric pressure.

3. The compressor apparatus of claim 2 further including prime mover means for driving said movable member alternately between said first and second positions.

4. The compressor apparatus of claim 3 further including vacuum pump means communicating with the space between said movable member and said piston member for maintaining said space at an absolute pressure below atmospheric pressure, whereby the pressure of said working fluid on said piston member first face moves said piston member outward in a compression chamber volume increasing direction during location of said movable member in said first position covering said piston member and atmospheric pressure on said piston member second face moves said member inward in a compression chamber volume decreasing direction to compress said working fluid during location of said movable member in said second position disengaged from said piston member.

5. The compressor apparatus of claim 4 wherein said prime mover means includes a quick return linkage capable of increasing the time of said movable member in said piston member covering first position with respect to time in said piston member exposing second position, whereby greater time for piston member movement in the outward, compression chamber volume increasing, direction is available.

6. The compressor apparatus of claim 5 wherein said vacuum pump means includes pressure-sensing means for maintaining said space between said movable member and said piston member at a predetermined below-atmospheric pressure level with intermittent actuation of said vacuum pump means.

7. The compressor apparatus of claim 6 wherein said working fluid is a refrigerant gas.

8. The compressor apparatus of claim 7 wherein said working fluid is a Freon ® refrigerant gas.

9. The compressor apparatus of claim 8 wherein said chlorinated hydrocarbon gas is R-11 refrigerant gas.

10. The compressor apparatus of claim 9 further including resilient seal means located intermediate said piston and compression chamber members, said movable member and said piston member, and said movable member and said base member for maintaining separtion of atmospheric gases producing said atmospheric pressure and said refrigerant gas.

11. The compressor apparatus of claim 10 wherein said first compression chamber outlet portion includes exhaust valve means for conducting compressed refrigerant gas from said first compression chamber and wherein said exhaust valve means includes controllable biasing means for determining the opening threshold pressure of said exhaust valve means.

12. A method for compressing a working fluid vapor in a refrigeration cycle comprising the steps of:

moving a compression member away from a home position through a vapor intermediate-pressure compressing stroke by exposing said compression member to atmospheric pressure;

returning said compression member to said home position with the urging of exposure to a below atmospheric pressure plenum;

applying prime mover derived additional compression to said vapor, raising said vapor thereby to a pressure corresponding to temperature exceeding the available condensing fluid temperature; and maintaining said below atmospheric pressure at a substantially constant value by intermittently removing leaked atmospheric gases and working fluid vapor from said from said below atmospheric pressure plenum.

* * * * *

UNITED STATES PATENT AND TRADEMARK OFFICE

CERTIFICATE OF CORRECTION

PATENT NO. : 4,679,986

DATED : July 14, 1987

INVENTOR(S) : Milburn E. Dupre'

It is certified that error appears in the above-identified patent and that said Letters Patent is hereby corrected as shown below:

Col 3, line 16, "FIG. 13" should be --FIG. 1-3--.

Col 3, line 60, "shwon" should be --shown--.

Col 4, line 17, "22" should be --222--.

Col 5, line 8, left out "2." and "such" should be capped.

Col 5, line 35, "the" should be --this--. (2nd occurrence)

Col 5, line 42, should be a paragraph starting with sentence "as is known by persons . . .".

Col 6, line 3, "gase" should be --gas--.

Col 7, line 22, "cause" and "possibly" are transposed.

Col 9, line 34, "refrigeration" should be --refrigerant--.

Col 9, line 60, deleted second occurrence of "the", not first.

Col 10, line 48, Claim 2, word "capable" omitted between "portions" and "of".

UNITED STATES PATENT AND TRADEMARK OFFICE

CERTIFICATE OF CORRECTION

PATENT NO. : 4,679,986

DATED : July 14, 1987

INVENTOR(S) : Milburn E. Dupre'

It is certified that error appears in the above-identified patent and that said Letters Patent is hereby corrected as shown below:

Col. 12, line 11, Claim 10, "separtion" should be --separation--.

Signed and Sealed this

Twenty-third Day of February, 1988

*Attest:*

DONALD J. QUIGG

*Attesting Officer*

*Commissioner of Patents and Trademarks*